United States Patent [19]

McMinn, Jr.

[11] 4,261,856

[45] Apr. 14, 1981

[54] AMMONIA SYNTHESIS GAS PRODUCTION

[75] Inventor: Talmage D. McMinn, Jr., Des Peres, Mo.

[73] Assignee: Monsanto Company, St. Louis, Mo.

[21] Appl. No.: 69,670

[22] Filed: Aug. 24, 1979

[51] Int. Cl.[3] ..... C10K 1/02

[52] U.S. Cl. ..... 252/373; 252/376

[58] Field of Search ..... 252/373, 376

[56] References Cited

U.S. PATENT DOCUMENTS 3,993,583 11/1976 Seglin ..... 252/373

*Primary Examiner*—Alan Siegel

*Attorney, Agent, or Firm*—Paul L. Passley; James C. Logomasini; Stanley M. Tarter

[57] ABSTRACT

Ammonia synthesis gas is prepared by contacting coal with air and steam in a fluidized bed. Heat for the reaction is provided by downward flowing hot char through the fluidized bed. The char is heated externally of the fluidized bed by combustion of fuel and/or a portion of the char. Control of the ratio of steam and air to the coal provides a gasification product of approximately 3 moles carbon monoxide plus hydrogen per mole of nitrogen.

9 Claims, 1 Drawing Figure

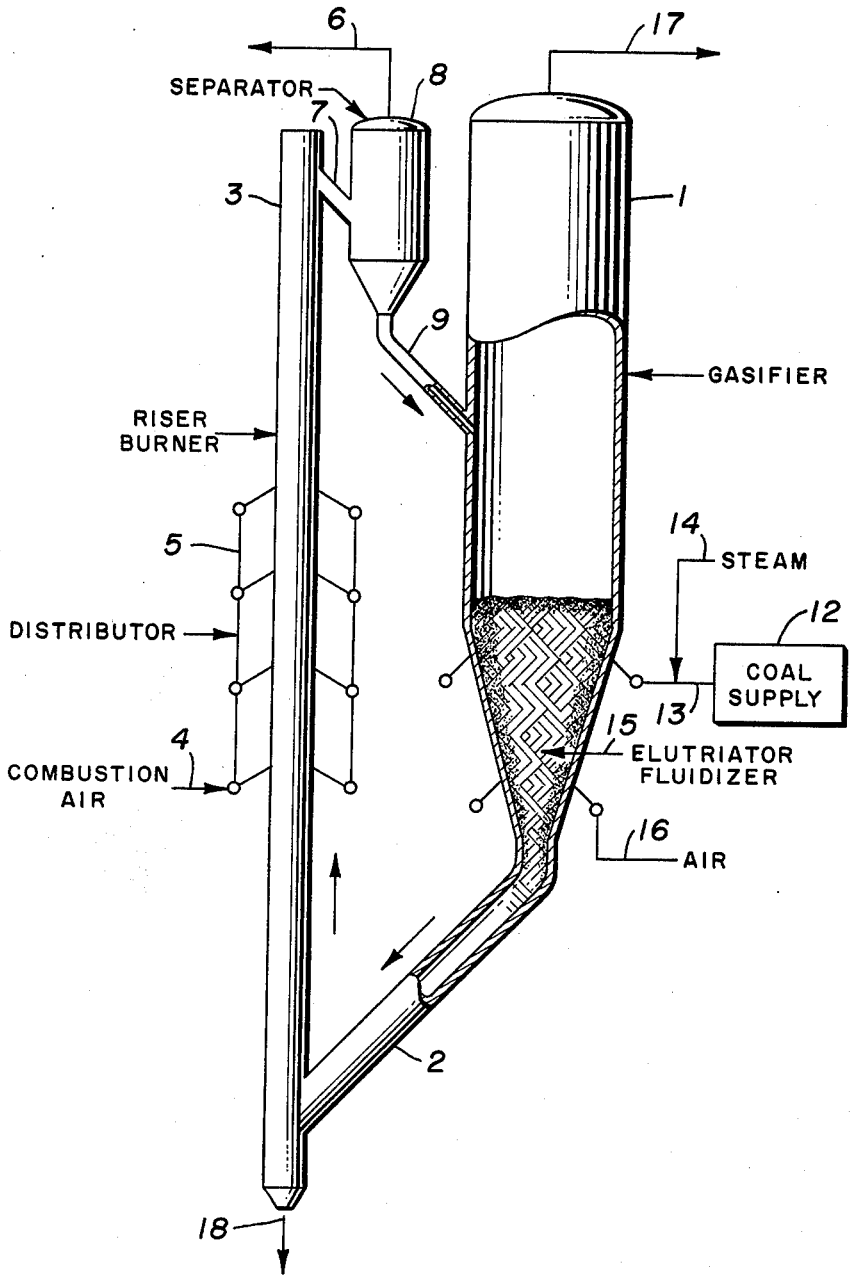
6
17
SEPARATOR
8
7
3
1
9
GASIFIER
RISER
BURNER
5
14
STEAM
12
DISTRIBUTOR
COAL
SUPPLY
13
15
4
ELUTRIATOR
FLUIDIZER
COMBUSTION
AIR
16
AIR
2
18

AMMONIA SYNTHESIS GAS PRODUCTION

BACKGROUND OF THE INVENTION

This invention relates to the production of a mixture of hydrogen and nitrogen from solid carbonaceous materials and air. Ammonia synthesis gas is such a mixture having a molecular ratio of about 3 hydrogen to 1 nitrogen.

Ammonia synthesis gas is generally prepared by two-stage stream reforming of natural gas, with air in the correct proportion being introduced between stages. The air is introduced to provide nitrogen; however, combustion of part of the synthesis gas reduces the heat necessary to drive the endothermic reforming reaction to completion. This system produces an intermediate synthesis gas containing hydrogen, carbon monoxide and nitrogen, with the carbon monoxide plus hydrogen being approximately three times the moles of nitrogen. This gas is then catalytically reacted with steam in the so-called water gas shift reaction. In this well-known reaction, carbon monoxide reacts mole for mole with steam to produce one mole of hydrogen per mole of carbon monoxide. Thus, in a hydrogen-carbon monoxide mixture, carbon monoxide can be viewed as "potential" hydrogen. After the shift reaction, the gas is processed to remove water, carbon dioxide, and any traces of sulfur which may have been introduced in the hydrocarbon feed, resulting in a gas containing only hydrogen and nitrogen in the desired ratio.

With the decreasing reserves of natural gas, it has become apparent that other carbonaceous raw materials will ultimately be used in the manufacture of ammonia, methanol, and other synthesis gas derived products. Coal can be reacted with oxygen and steam to produce a mixture of hydrogen and carbon monoxide with minor amounts of carbon dioxide and sulfur compounds. If ammonia synthesis is the object of the gasification, the mixture is shifted and purified to produce pure hydrogen, after which an appropriate amount of nitrogen derived from air separation is blended with the purified hydrogen. A number of physical systems have been proposed to effect oxygen fueled gasification; however, generally they require an air separation plant or a purchased supply of pure oxygen. This adds to the capital cost and operating complexity; or, if purchased oxygen is used, the raw material costs chargeable to the product are greatly increased.

U.S. Pat. No. 2,795,559 discloses the production of a gas mixture of 3 volumes of hydrogen per volume of nitrogen by oxidatively gasifying a carbonaceous fuel, such as coal, with air as the sole source of oxygen at an elevated temperature and pressure to produce a synthesis gas containing a mixture of carbon monoxide, hydrogen and nitrogen, the latter being present in greater than one volume of nitrogen per three volumes of hydrogen. The carbon monoxide in said mixture is then reacted with steam, i.e., water gas shift reaction, to convert the carbon monoxide to carbon dioxide with the concomitant production of hydrogen. The carbon dioxide and water vapor are removed from the mixture leaving essentially a hydrogen and nitrogen mixture. The hydrogen and nitrogen mixture is then further refined by a series of steps wherein nitrogen in excess of 1 volume per 3 volumes of hydrogen is condensed at cryogenic conditions and removed to obtain the ammonia syn gas mixture. It is noted that the process described in this patent utilizes air in the gasification of the coal as the only source of oxygen and the reaction of air with the fuel, coal, is exothermic to maintain the gasification autogenously and supply heat for the endothermic water gas shift reaction.

U.S. Pat. No. 2,276,343 described a continuous process for gasifying lignite to produce hydrogen by preheating a lignite containing 25–40% water to drive off water-containing vapor and render the lignite highly reactive. The mixture of highly reactive lignite and water vapor are reacted at an elevated temperature to produce a hydrogen rich gaseous mixture which is then separated from the lignite and purified. The lignite is heated and maintained at 500° C. to 850° C. in the described process by external means. External steam may be introduced to the reaction to produce additional hydrogen.

U.S. Pat. No. 3,620,697 discloses a process for producing hydrogen by reacting carbon, such as coal, with water utilizing a circulating inert particulate material as the heat source for the endothermic reaction. The inert particulate material is heated by burning a carbonaceous material therewith while being conveyed to the reaction. Similarly, U.S. Pat. Nos. 3,968,052 and 3,850,839 disclose processes for gasifying coal-derived char with steam in a fluid bed system where the heat for the endothermic gasification reaction is supplied by circulating through the system inert pellets which are heated by burning fines from the gasifier in their presence externally of the gasifier.

SUMMARY

This invention provides a unified process for producing a raw gaseous product which is readily converted to gas suitable for conversion to ammonia from solid carbonaceous starting materials. This gas, as derived from the teaching of this invention, contains essentially carbon monoxide plus hydrogen and nitrogen with hydrogen plus carbon monoxide in a molar ratio to nitrogen of about three to one. In this process, coal char is used to supply endothermic heat for oxidatively gasifying solid carbonaceous material with air and steam. In a major aspect of this invention, the solid carbonaceous material is maintained in a fluidized reaction zone and heated char particles flow downward through the fluidized bed losing heat to the reaction mass as they progress downward.

Typical objects of this invention are (1) to provide a process for gasifying solid carbonaceous materials, (2) to provide a process for production of crude ammonia synthesis gas comprising hydrogen plus carbon monoxide and nitrogen in a desired ratio, and (3) to provide an improved process for the gasification of solid carbonaceous materials with air and steam to form a gaseous mixture of about 3 volumes of carbon monoxide plus hydrogen and 1 volume of nitrogen.

Various other objects, aspects and advantages of this invention will become apparent to those skilled in the art from the accompanying description, drawings, and appended claims.

According to this invention, solid carbonaceous materials, as typified by coal of rank ranging from lignite through anthracite are gasified by partial oxidation in the presence of steam. Partial oxidation in this context refers to oxidation of carbon, or a carbon-hydrogen material with a deficiency of oxidant, usually oxygen, so that the highest oxidation products cannot be obtained. Thus, at the temperatures employed in this invention, the oxidized carbon would exist essentially as carbon monoxide rather than carbon dioxide and hydrogen would be essentially non-oxidized. The overall reaction of solid carbon-hydrogen materials with steam and a deficiency of air is endothermic; that is, heat must be supplied to maintain the reaction at a temperature necessary to obtain desired products. The amount of heat supplied is a function of the heat of formation of the carbonaceous materials and the temperture(s) at which the various reactants are introduced into the reaction zone. A primary aspect of this invention is the use of coal char particles to carry heat from a heating device outside the reactor into the reaction zone. This invention embodies a fluidized bed reactor consisting of a primary gasification zone of a vertically cylindrical section immediately above and contiguous to an elutriation/fluidization zone of a circular conical section. Solid carbonaceous particles entrained in the reactant steam are injected into the fluidized bed of particles at the bottom of the cylindrical section. In the fluidized bed operation mixing and thermal equilibrium are rapidly attained; thus, the solid carbonaceous particles are very rapidly heated to temperature and react with steam and air which is introduced as an elutriation/fluidization gas near the base of the conical section. As has been previously discussed, the solid carbonaceous material-air-stream reaction conducted in a deficiency of air is endothermic. The heat carrier particles, heated to a temperature above the reaction temperature, are introduced near the top of the gasification zone and are cooled rapidly to bed temperature while supplying heat necessary to maintain the reaction temperature. The quantity of heat carrier particles and temperature at which they are introduced into the bed are directly related to the heat required to maintain bed temperature and optimized conditions can readily be calculated from heat balance relations for a specific solid carbonaceous material. As the heat carrier particles reach the conical section, the cross-sectional area available for solids flow downward and gas flow upward decreases with the result that the smaller, lighter solid carbonaceous particles are, for the most part, blown back into the gasification zone while the heat carrier particles flow from the bottom of the elutriation/fluidization zone into a conduit leading to a riser-burner. The heat carrier particles, after removal of aggregates of ash, carbon and heat carrier, singly or in concert, flows up to the riser-burner due to a pressure balance to the point where preheated combustion air is introduced, engages the particles and transports them on up the rise-burner. Combustion of a portion of the char supplies heat to the char particles for ultimate release into the gasification zone. Char particles plus gas flow to a separator where the disengaged char particles then flow back to the gasification zone, thus completing this cycle, while the combustion gas, nitrogen plus carbon monoxide are cooled to recover heat, filtered of particles by auxiliary equipment and are discharged harmlessly to the atmosphere.

Suitable conditions employed for carrying out this process can be generally typified as follows:

| | FROM | TO | PREFERRED |
|---|---|---|---|
| Superficial gasification velocity, feet per sec. | 1 | 5 | 2–3 |
| Superficial elutriation gas velocity, feet per sec. at bottom of cone | 4 | 10 | 6–7 |
| Superficial riser-burner gas velocity, feet per sec. | 12 | 40 | 18–22 |
| Reactor Temperature, °C. | 925 | 1200 | 1000 |
| Riser-Burner Temperature °C. | 1050 | 1300 | 1150 |
| System Pressure, atmospheres | 1 | 65 | 28–32 |

The ratio of air and steam to solid carbonaceous material in the gasifier feed will depend entirely on the elemental analysis of the coal to obtain the 3/1 molar ratio of carbon monoxide plus hydrogen to nitrogen which will generally be desired. Generally, a weight ratio of 0.25 to 0.75 lbs. $H_2O$/lb. coal is present in the gasifier and a weight ratio of 0.6 to 10 lbs. air/lb. coal is present in the elutriation/fluidization zone. Also, solid carbonaceous solids, e.g., coals of various ranks, are not of uniform composition even in a given mine. Regulation of the process can be accomplished by air-steam-coal ratio control based on continuous analysis of the gas product. Although a molar ratio of 3 hydrogen to 1 nitrogen is desirable for ammonia synthesis gas, a broad molar ratio of carbon monoxide plus hydrogen to nitrogen such as 2:1 to 4:1 can be prepared in accordance with this invention by varying the steam and/or air additions. Additional hydrogen or nitrogen may be added to bring the ratio to 3 to 1 for ammonia synthesis.

In the preferred method of operation of the various zones, coal char particles are continuously circulated through the reaction system. Throughout the system linear gas velocities are maintained such that the char particles are entrained in the gases in the riser-burner zone and flow downward through the fluidized bed of solid carbonaceous material in the gasifier and elutriation zones. Gas velocities of 12 to 40 feet per second are employed in the riser-burner zone and 1 to 5 feet per second in the gasifier zone and 4 to 10 feet per second in the elutriation zone. Actual gas velocities employed will be dependent upon the apparatus, size and shape, employed and the densities of the solid materials. In this type of operation, means will be provided externally of the gasification zone for separating solid materials entrained in the gaseous effluent withdrawn from the gasifier zone.

The temperature employed in the gasification zone can vary over a wide range. Preferably, such reaction will be conducted from 925° C. to 1200° C. Pressure on the system can also vary. The system can be operated under pressures from 0 psig to 1000 psig. Temperatures in the riser-burner zone will generally be from 1050° C. to 1300° C.

As previously indicated, the process of this invention utilizes a fluidized bed of solid carbonaceous material in the gasifier zone. The fluidization of the solids is obtained by introducing air, also a reactant, into the system. Air is introduced at such rates to fluidize the solids.

This invention will be more specifically described with reference to the drawings. FIG. 1 is a diagrammatic illustration of the apparatus in the system described with regard to gasifying coal.

According to FIG. 1, coal char in particulate form from gasifier 1 is introduced through conduit 2 to riser-burner zone 3. Combustion air is introduced through conduit 4 and distributor 5 into riser-burner zone 3. Riser-burner zone 3 is maintained under conditions whereby the char particles are heated. The exothermic burning reaction heats the char particles. The char particles are transported upwardly through riser-burner zone 3 through conduit 7 into gas-solids separator 8. Combustion gases are removed through conduit 6 and vented. The heated char particles flow through conduit 9 into gasifier zone 1. Coal from supply 12 is introduced through conduit 13 to gasifier 1. Steam is introduced through conduit 14 into conduit 13 to transport the coal therethrough and introduce steam to gasifier 1. Below gasifier 1 is elutriation/fluidization zone 15 where the char particles after flowing downward through the bed of coal in gasifier zone 1 are separated from the coal and flow from elutriation/fluidization zone 15 through conduit 2 into the lower portion of riser-burner 3. Air is introduced through conduit 16 into the lower portion of elutriation/fluidization zone 15 to aid in separation of the char particles and to fluidize the bed of and react with coal in gasifier 1. Gasification product gases are removed from the upper portion of gasifier 1 through conduit 17 for recovery of ammonia syn gas.

EXAMPLES

The practice of this invention will now be more fully illustrated in the following Examples. In these Examples, the reactor employed for carrying out the particular coal gasification runs comprises a 20-inch RA 330 schedule 40 pipe with a 1.61-inch inside diameter main having a Type 310 stainless steel conical section at the bottom fitted with a water-cooled injection nozzle for introducing finely divided coal conveyed with air. In each run, the reactor contains sufficient char to provide a fluidized bed height of 18 inches. The reactor is equipped with two dip tubes, one extending from the top through the inert material to about ¼ inch above the coal injection nozzle for the introduction of steam and the other extends to the top of the fluidized bed for removal of reaction gases and excess solids (ash and unreacted coal). The reactor is enclosed in an insulated electric radiant heater.

invention. Characterization and results of each run is given in Table 1.

EXAMPLE 2

This Example, with reference to the drawing of FIG. 1 illustrates the continuous stable gasification of Wyoming sub-bituminous coal according to this invention. Additions to or modifications of flows and conditions during periods of non-steady state operation will be apparent to those skilled in the art. These periods include transient conditions of start-up and shut-down as well as inevitable upsets caused by changing feedstock and/or production rates imposed by opertions of auxillary equipment necessary to, but not integral with this invention. Further, ancilliary equipment necessary to the operation of a process utilizing this invention, but not germane to the invention as disclosed here include heat exchangers, compressors, coal handling and conditioning equipment, solids conveying equipment, and gas-solids separators.

Powdered coal (−50 mesh), 100 pounds is fed via conduit 13 where it is joined by 3.1 pounds of steam at 500 psig and 350° C. from conduit 14 which pneumatically conveys the coal into the lower portion of the fluidized bed in gasifier 1. The coal is very rapidly heated to the reaction temperature, 1025° C., in the fluidized bed and reacts with 843 Scf of air preheated to 825° C. fed via conduit 16 and the conveying steam to produce a gas containing 6.7 pounds hydrogen, 66.7 pounds carbon monoxide, 53.6 pounds nitrogen, and 18.5 pounds carbon dioxide. Traces of hydrogen sulfide will also be formed if the coal contains sulfur impurities. The raw synthesis gas exits the reactor through conduit 17 and is processed by downstream equipment, now shown, to recover heat (71.3 M BTU), preheating incoming air, remove sulfur, entrained ash, and carbon particles, and further chemical reaction.

TABLE 1

| RUN A COAL | N. DAKOTA TEXAS LIGNITE | RUN B WYOMING LIGNITE | RUN C WYOMING SUB-BITUMINOUS | RUN D SUB-BITUMINOUS |
|---|---|---|---|---|
| Analysis (Wt. %) | | | | |
| C | 41.23 | 44.60 | 61.48 | 61.48 |
| H | 3.79 | 5.95 | 6.07 | 6.07 |
| N | 0.81 | 0.69 | 1.20 | 1.20 |
| S | 0.22 | 0.31 | 0.74 | 0.74 |
| O | 16.10 | 13.57 | 12.40 | 12.40 |
| $H_2O$ | 30.00 | 29.93 | 15.82 | 15.82 |
| Ash | 7.84 | 4.95 | 2.29 | 2.29 |
| Inert Solids | Lignite Char | Lignite Char | Coal Char | Coal Char |
| Weight (gms) | 73 | 36.42 | 54.17 | 39.10 |
| Temperature (°C.) | 1002 | 943 | 977 | 1050 |
| Pressure atm.abs. | 1 | 1 | 1 | 3 |
| Feed Coal (gm/min.) | 1.007 | 0.483 | 0.472 | 1.057 |
| Steam (gm/min.) | 0.285 | 0.150 | 0.130 | 0.520 |
| Air (Std. Liters/min.) | 0.622 | 0.350 | 0.320 | 0.750 |
| Run Time (min.) | 120 | 150 | 150 | 120 |
| Gas Residence Time (sec.) | 5.1 | 10.8 | 10.2 | 10.5 |
| Product Analysis (gram moles) | | | | |
| C | 2.99 | 1.43 | 0.83 | 1.63 |
| $O_2$ | 0.03 | 0.02 | 0.02 | 0.00 |
| $N_2$ | 2.53 | 1.70 | 1.55 | 3.54 |
| $CO_2$ | 0.14 | 0.17 | 0.18 | 0.20 |
| CO | 3.96 | 2.72 | 2.48 | 5.68 |
| $H_2$ | 3.91 | 2.41 | 2.68 | 5.71 |
| $CO + H_2/N_2$ Ratio | 3.11 | 3.02 | 3.33 | 3.22 |

EXAMPLE 1

This Example illustrates the gasification of various solid carbon-containing materials, steam and air to produce ammonia synthesis gas in accordance with this Since the gasifier 1 is operated below the ash fusion temperature, the mineral content of the coal will be removed as a fine dust, fly ash. The reaction, with coal entering at 25° C., steam at 325° C. and air entering at 825° C. is endothermic requiring 161 M BTU to be supplied. This endothermic heat requirement is supplied by a flow of coal char heat carrier of a size suitable for fluidization. The heated char is introduced near the top of the fluidized bed of coal in the gasifier 1 from riser-burner 3 and separator 8 through conduit 9 at a rate of 1909 pounds per minute and a temperature of 1125° C. The char passes downward through the fluidized bed by virtue of its particle size and density rapidly giving up heat to maintain bed temperature at 1025° C. Char, 1930 pounds, is essentially separated from coal in the conical lower section of gasifier 1 by elutriation in the incoming air and leaves the reactor at a temperature of 1025° C. via standpipe 2. Any large, relative to the heat carrier particles, particles of coal are trapped at the bottom of the riser-burner 3 and intermittently removed via conduit 18. Combustion air, 2351 Scf at 825° C. is introduced stagewise through conduit 4 and distributor 5, and transports the char upward in the riser-burner where it is heated from 1025° C. to 1125° C. by combustion of 21 pounds char fed into the riser-burner 3 from the gasifier 11. The mixture of hot combustion gas and heated char is separated in separator 8 with solids at 1125° C. being returned to the gasifier 1 via conduit 9 and combustion gas, 24.5 pounds carbon monoxide, 38.4 pounds carbon dioxide and 146.7 pounds nitrogen, at 1125° C., leaving the separator through conduit 6 for heat recovery (183.1 M BTU) and cleanup before being vented to the atmosphere.

The product gas contains $CO+H_2/N_2$ in a ratio which, after water gas shift of the CO, provides a hydrogen-nitrogen mixture suitable for ammonia synthesis. At theoretical conversion of the synthesis gas to ammonia, gasification of 100 pounds of coal results in 65.1 pounds of ammonia (1 ton of ammonia requires gasification of 1.54 tons of coal) and produces 5.63 MM BTU of heat.

As shown in the drawing and Example 2, stagewise introduction of combustion air into riser-burner 3 results in non-equilibrium burning of the char to a higher $CO_2$ content than anticipated by thermodynamic equilibrium and thus less char is required to be burned to sufficiently heat the char to provide the heat for the gasification.

What is claimed is:

1. A continuous process for the gasification of solid carbonaceous materials in a fluidized bed system comprising a lower elutriation/fluidization zone and an upper gasifier zone and an associated riser-burner zone which comprises:

(a) introducing particulate solid carbonaceous material and steam into the lower portion of said gasified zone, (b) introducing air into the lower portion of said elutriation/fluidization zone, (c) entraining and fluidizing said particulate solid carbonaceous material in said air, (d) introducing coal char particles at an elevated temperature into the upper portion of said gasifier zone, (e) allowing said char particles to flow downward through said fluidized bed of solid carbonaceous carbon material in said gasifier zone, (f) maintaining said gasifier zone under conditions so that said carbonaceous material, steam and air are endothermically reacted to a mixture of carbon monoxide, hydrogen and nitrogen, (g) said char particles being the source of heat for said endothermic reaction, (h) withdrawing a gaseous effluent comprising carbon monoxide, hydrogen and nitrogen from the upper portion of said gasifier zone, (i) separating said char particles from said solid carbonaceous material in said elutriation/fluidization zone, (j) withdrawing said separated char particles from said elutriation/fluidization zone and removing ash containing particles therefrom, (k) introducing said separated ash poor char particles into the lower portion of said riser-burner zone, (l) introducing air to the lower portion of said riser-burner zone, (m) maintaining exothermic conditions by burning a portion of said ash poor char particles in said riser-burner zone to heat said ash poor char particles to an elevated temperature sufficient to effect gasification of said solid carbonaceous material in said gasifier zone, and (n) withdrawing said heated ash poor char particles from said riser-burner zone and reintroducing it into said gasification zone.

2. The process of claim 1 wherein said solid carbonaceous material is coal.

3. The process of claim 2 wherein said coal is a coal of rank ranging from lignite through anthracite.

4. The process of claim 3 wherein said coal is lignite.

5. The process of claim 1 wherein the temperatures maintained in said gasifier zone is from 925° C. to 1200° C. and in said riser-burner zone is 1050° C. to 1300° C.

6. The process of claim 5 wherein said gaseous effluent contains carbon monoxide plus hydrogen to nitrogen in a molar ratio of 2 to 1 to 4 to 1.

7. The process of claim 1 wherein the superficial gas velocity in the gasifier zone is 1 to 5 feet per second, in the elutriation/fluidization zone is 4 to 10 feet per second and in the riser-burner zone is 12 to 40 feet per second.

8. A continuous process for the gasification of coal in a fluidized bed system comprising a lower elutriation/fluidization zone and an upper gasifier zone and an associated riser-burner zone which comprises:

(a) introducing particulate coal selected from the group consisting of lignite, bituminous, sub-bituminous and anthracite and steam at a weight ratio of 0.25 to 0.75 lbs. $H_2O$/lb. coal into the lower portion of said gasifier zone, (b) introducing air to provide an air to coal weight ratio of 0.6 to 10 lbs. air/lb. coal into the lower portion of said elutriation/fluidization zone at a rate to provide a superficial gas velocity of 4 to 10 ft./sec. in said elutriation/fluidization zone and of 1 to 5 ft./sec. in said gasifier zone to entrain and fluidize said particulate coal, (c) introducing coal char particles at a temperature of 1050° C. to 1300° C. into the upper portion of said gasifier zone, (d) allowing said char particles to flow downward through said fluidized bed of coal in said gasifier zone to maintain said gasifier zone at a temperature of 925° C. to 1100° C. so that said coal, steam and air are endothermically reacted to form a mixture of carbon monoxide, hydrogen and nitrogen, said char particles being the source of heat for said endothermic reaction, (e) withdrawing a gaseous effluent comprising said mixture of carbon monoxide, hydrogen and nitrogen from the upper portion of said gasifier zone, (f) separating said coal from said char particles by elutriation with said air introduced to said elutriation/fluidization zone, (g) withdrawing said separated char particles from said elutriation/fluidization zone and removing ash containing particles, (h) introducing said separated ash poor char particles into the lower portion of said riser-burner zone, (i) introducing air to the lower portion of said riser-burner zone, sufficient to burn a portion of said ash poor char particles to heat said ash poor char particles to a temperature of 1050° C. to 1300° C., and (j) withdrawing said heated ash poor char particles from said riser-burner zone and reintroducing them into said gasification zone.

9. The process of claim 8 wherein said gaseous effluent contains carbon monoxide plus hydrogen to nitrogen in a molar ratio of 2 to 1 to 4 to 1.

* * * * *